United States Patent [19]

Mouissie

[11] Patent Number: 4,959,626

[45] Date of Patent: Sep. 25, 1990

[54] FILTER CONNECTOR WITH LOW FREQUENCY SCREENING

[75] Inventor: Bob Mouissie, Berlicum, Netherlands

[73] Assignee: E. I. Du Pont de Nemours and Company, Wilmington, Del.

[21] Appl. No.: 318,149

[22] Filed: Mar. 2, 1989

[30] Foreign Application Priority Data

Mar. 11, 1988 [NL] Netherlands ..... 8800609

[51] Int. Cl.[5] ..... H01P 13/648; H01R 13/66

[52] U.S. Cl. ..... 333/182; 439/607; 439/620

[58] Field of Search ..... 333/182–185; 361/302, 328–330; 439/607–610, 620

[56] References Cited

U.S. PATENT DOCUMENTS

| | | | |
|---|---|---|---|
| 3,977,755 | 8/1976 | Edel et al. | 439/610 |
| 4,126,840 | 11/1978 | Selvin | 439/607 X |
| 4,386,819 | 6/1983 | Asick et al. | 439/610 |
| 4,682,129 | 7/1987 | Bakenmans et al. | 361/302 X |
| 4,726,638 | 2/1988 | Farrar et al. | 439/620 |
| 4,726,790 | 2/1988 | Hadjis | 333/185 X |
| 4,729,743 | 3/1988 | Farrar et al. | 439/276 |
| 4,729,752 | 3/1988 | Dawson, Jr. et al. | 439/620 |

FOREIGN PATENT DOCUMENTS

| | | | |
|---|---|---|---|
| 0073600 | 9/1983 | European Pat. Off. . | |
| 0211508 | 2/1987 | European Pat. Off. . | |
| 2910906 | 10/1980 | Fed. Rep. of Germany | 437/607 |
| 2098412 | 11/1982 | United Kingdom . | |

*Primary Examiner*—Eugene R. LaRoche
*Assistant Examiner*—Benny Lee

[57] ABSTRACT

A connector, comprising an elongated body (1) of electrically insulating material, which has at its ends elements (6) for fastening the connector, and which carries several contact elements (2) of electrically conducting material. When assembled, one or more of the contact elements (2) being connected to an electrode (14) of one or more filter elements formed on a substrate (12), another electrode (15) of which is connected to a screen of electrically conducting material partially enclosing the contact elements (2). Said screen comprises a first frame-type cover (16) which is made up of two halves (18) and encloses the contact ends (3) of the contact elements (2), having lips (20) which project in the direction of the connection ends (4) of the contact elements (2), and to which said other electrode (15) of the filter elements is connected. Further, a second frame-type cover (17) partially enclosing the connection ends (4) of the contact elements (2) and to which also said other electrode (15) of the filter elements is connected. Said first (16) and second (17) frame-type covers engaging with each other in a manner such that the substrate (12) with the filter elements is confined between them and a connector optimum screened against interference signals is obtained.

10 Claims, 1 Drawing Sheet

FILTER CONNECTOR WITH LOW FREQUENCY SCREENING

BACKGROUND OF THE INVENTION

The invention relates to a connector, comprising an elongated body of electrically insulating material, which has at its ends elements for fastening the connector, and which carries several contact elements of electrically conducting material, with a contact end for contacting a further connector and a connection end for the connection of an electrical wiring, one or more of the contact elements being connected to an electrode of one or more filter elements formed on a substrate, another electrode of which is connected to a screen of electrically conducting material partially enclosing the contact elements. A connector of this type is known per se in practice.

Connectors for use in, for example, motor vehicles have to meet high standards as regards screening from interference signals. The interference signals produced in a motor vehicle, such as a car, during use extend over a wide frequency range, going from a few Hz to several MHz.

Although the electronic equipment with housings of electrically conducting material used in a motor vehicle can be screened effectively against undesirable interference signals (Faraday cage), the interference signals produced can still reach the electronic components thereof via the connectors for connecting the various electronic units.

In order to suppress interference signals of higher frequency, it is advantageous, in practice, to use a filter unit which is connected to the contact elements, such as disclosed in applicant's copending U.S. application Ser. No. 07/211,253 filed Jun. 24, 1988 and assigned to the same assignee as the present application. Such a filter unit in general comprises a flat substrate on which capacitor elements are formed. These capacitor elements are provided with passages for the connection ends of the contact elements and comprise at least one common electrode which can be connected near the edges of the substrate, and at least one electrode patch which is separated therefrom by means of a dielectric and encloses a matching passage. The electrode patches are connected to the respective connection ends of the contact elements, and the at least one common electrode is connected to the ground of the circuit.

The sensitivity to interference signals of lower frequencies can effectively be reduced with a screen of electrically conducting material enclosing the contact elements, which is also connected to the ground of the circuit.

SUMMARY OF THE INVENTION

The object of the invention is to produce a screen against low frequencies such that the electrode(s) of the filter unit to be connected to the ground can also be connected thereto, so that a connector optimally screened against interference signals can be obtained.

This is achieved according to the invention in that the screen comprises a first frame-type cover which is made up of two halves and encloses the contact ends of the contact elements, having lips which project in the direction of the connection ends and past the contact ends, and to which the other electrode of the filter elements is connected, the halves engaging with each other at their ends, a second frame-type cover partially enclosing the connection ends of the contact elements and to which also the other electrode of the filter elements is connected, the first and second frame-type covers engaging with each other in such a way that the substrate with the filter elements is confined between them.

The first cover according to the invention, made up of two halves, permits easy assembly of the connector. The halves of the first cover are first fitted together after which the filter elements can be connected to the first cover and the connection ends of the contact elements and, finally, the second cover is fitted and connected to the respective electrode(s) of the filter elements.

In order to achieve a smooth transition between the two halves of the first frame-type cover, i.e. that they lie in line with each other, a further embodiment of the connector according to the invention is characterized in that the two halves of the first frame-type cover engage with each other by means of a dovetail joint at either end thereof. Such a dovetail joint also prevents the two halves from shifting in relation to each other when the unit is assembled.

A further embodiment of the connector according to the invention is characterized in that the elongated body carrying the contact elements has a U-shaped cross section within which the contact ends of the contact elements extend, with a raised edge along the external periphery having slit-type passages for taking the lips of the first frame-type cover.

If the connector according to the invention is used in motor vehicles, it must also be well able to withstand vibrations, shocks or impacts, particularly the connections between the first and second cover and the substrate with the filter elements. Yet another embodiment of the connector according to the invention is characterized in that the lips of the first frame-type cover are bent backwards over a distance at their free end and form a first stop situated in the frame opening, while the second frame-type cover is provided at one end with a second stop in the frame opening, the lips of the first frame-type cover extending such a distance within the second frame-type cover that the substrate with the filter elements is confined between the first and second stop.

A preferred embodiment of the connector according to the invention for easy attachment thereof to a chassis is also characterized in that the first and second frame-type covers are of such dimensions that the elements for fastening the connector are accessible from the outside, the elements being made bar-shaped, with a bore in the lengthwise direction at at least one end, for fastening the connector with a screw connection, and with at least one projection, extending parallel to the contact ends and having a further bore in the lengthwise direction, which is accessible from the free end thereof, for fastening the connector with a screw connection.

For fastening the connector in this way, it is possible to use either so-called self-tapping or sheet metal screws, or even screws with cylindrical screw thread, but the bores then have to be provided with corresponding screw thread.

A connector made up according to the preferred embodiments can be fitted either along a wall or in an opening in a wall of a chassis, in which case the connector can be fixed by means of the projections extending in the direction of the contact ends to the wall of the chassis bounding the opening. An embodiment of the connector according to the invention is further characterized in that the bar-shaped element situated at the one end is provided with one projection arranged in or near the center thereof, and the bar-shaped element situated at the other end is provided with a projection on either side of the periphery of the elongated body.

If the connector according to the invention is used in motor vehicles or other damp environments, moisture penetrating into the connector can adversely affect the filter action of the filter elements. The penetration of moisture is effectively limited according to the invention through the fact that at the side where the connection ends project outwards the second frame-type cover is sealed with a sealant to prevent moisture from penetrating into the connector.

BRIEF DESCRIPTION OF THE DRAWINGS

The invention is explained in greater detail below with reference to the preferred embodiment of the connector shown in the drawing.

DETAILED DESCRIPTION OF THE INVENTION

Figure 1:
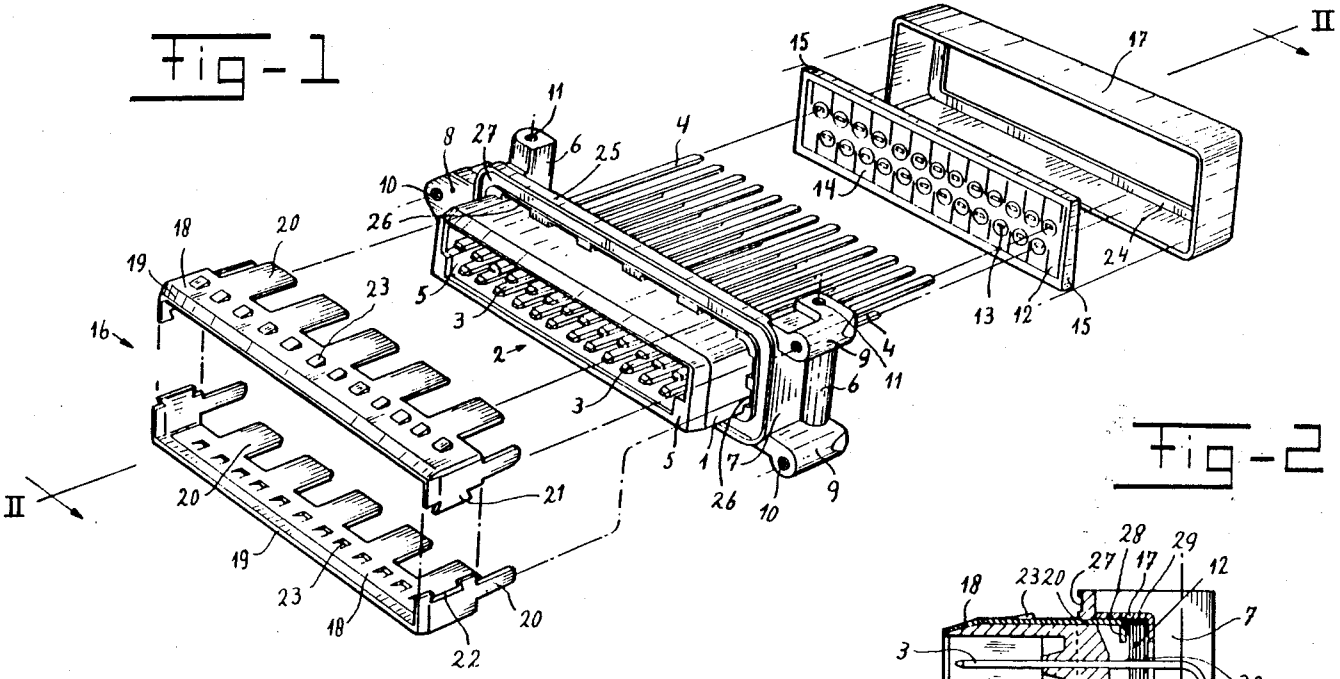
FIG. 1 shows schematically, in perspective, and in an exploded view, a connector according to the invention with a flat filter unit.

FIG. 1 shows schematically in perspective a preferred embodiment of the connector according to the invention, in an exploded view. The connector comprises an elongated body 1 of electrically insulating material with a U-shaped cross section, supporting two rows of contact elements 2. The contact elements 2 each have a contact end 3 for contacting the contact elements with a further connector and a connection end 4 for the connection of an electrical wiring. In the preferred embodiment shown, both the contact ends 3 and the connection ends 4 are designed as pins with a rectangular cross section. It will be clear that the contact elements 2 can also be, for example, round, elliptical or polygonal in cross section and/or can have contact ends 3 designed as contact sockets (not shown). The contact elements 2 can be connected by means of the connection ends 4 to, for example, a printed circuit board. By means of "wire-wrap" connections, electrical connection wires, for example can be connected to the connection ends 4. At the side of the contact ends 3 the body 1 is provided with "polarity cams" 5 to prevent wrong contacting of a further connector.

The elongated body 1 is provided at each narrow edge with a bar-shaped element 6 for connecting the connector to a chassis. In the preferred embodiment of the connector shown the two bar-shaped elements 6 are displaced relative to the elongated body 1 in the direction of the connection ends 4 of the contact elements. The bar-shaped elements 6 are each connected by means of a connection piece 7 to the elongated body 1.

For fixing the body 1 in an opening of a chassis, the bar-shaped elements 6 are provided according to the invention with elongated projections 8, 9 extending parallel to the contact elements 2, in the direction of the contact ends 3 thereof. In the embodiment shown one of the bar-shaped elements 6 has a projection 8 virtually in the centre of the body 1, and the bar-shaped element 6 at the other narrow end of the body 1 is provided with a projection 9 at each of its ends. Bores 10 are provided in the lengthwise direction of the projections 8, 9 for fixing the projections 8, 9 to a chassis by means of screws. For this, so-called sheet metal screws or self-tapping screws can be used, or it is even possible to use screws with cylindrical screw thread, but the bores then have to be provided with corresponding screw thread.

For fitting the connector along a wall of a chassis, the bar-shaped elements 6 are provided at their ends with bores 11, with which the connector can be fixed to the wall of a chassis, also using screws. These bores 11 can also be provided with internal screw thread if necessary.

As already mentioned in the introduction, the connector is provided with a filter unit 12, to be connected to the connection ends 4, for damping the interference signals acting on the contact elements 2, in particular the higher interference signal harmonics.

The filter unit 12 shown comprises a flat substrate with passages 13 whose siting corresponds to the siting of the contact ends 4 of the contact elements. The passages 13 each comprise one or more electrode patches 14 which are electrically separated from each other and which are separated by means of a dielectric layer from a common electrode to be connected to the ground and in this way form anti-interference capacitors. This common electrode extends along one or more edges 15 of the substrate. The electrode patches 14 are connected by means of a soldered joint to the respective connection ends 4 of the contact elements. It goes without saying that other suitably constructed filter units can also be used.

For the connection of the common electrode(s) accessible at one or more of the edges 15 of the filter unit 12, provision is made according to the invention for a screen comprising a first 16 and a second 17 frame-type cover.

The first frame-type cover 16 is made up of two identical frame halves 18. At their one side the frame halves 18 are provided with an edge 19 slanting towards the frame opening, and at their other, opposite side lips 20 are formed. At the ends the two frame halves have so-called dovetail joints, comprising a dovetail-shaped projection 21 formed on the one frame half and a recess 22 corresponding in shape therewith in the other half of the frame. The frame halves 19 are also provided with outward-projecting elevations 23 for producing a clamping action when a further connector is contacted. The second frame-type cover 17 is rectangular in shape and has a stop 24 projecting at one side in the frame opening.

For fixing the first frame-type cover 16 to the elongated body 1, the body 1 in the preferred embodiment of the connector shown is provided with a raised edge 25 formed on the outer periphery and running all the way round. The edge 25 has slit-type passages 26 for taking the lips 20 of the first frame-type cover 16. As shown, the edge 25 is also provided with a groove 27 to accommodate a packing ring when the connector is fitted in an opening in a wall of a chassis.

Figure 2:
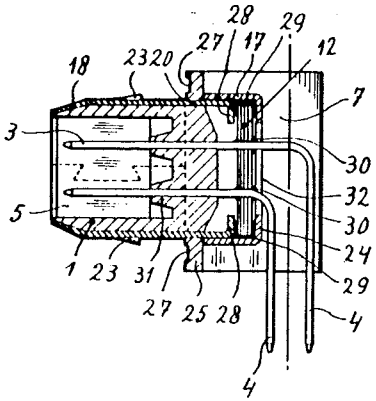
FIG. 2 shows schematically a cross section of the assembled connector constructed according to FIG. 1, with flanged connection ends for mounting on a printed circuit board.

FIG. 2 shows a cross section of a connector assembled according to FIG. 1, viewed in the direction indicated by the arrows II—II. The connection ends 4 of the contact elements are bent at right angles in such a way that they remain within the space bounded by the bar-shaped elements 6. In this way the space taken up by the connector on, for example, a printed circuit board is reduced as much as possible. As a result of the position of the bar-shaped elements 6 being displaced relative to the surface of the body 1, the connector can be fitted, using screws and the like, via the bores 11 on a printed circuit board, near an edge thereof.

The two frame halves 18 of the first cover 16 fit closely against the outer periphery of the body 1 with U-shaped cross section when the connector is assembled. The dovetail joint at the ends of the frame halves 18 is indicated by a dotted line. At their free end, the lips 20 are bent backwards for a distance at right angles in the frame opening and form a stop 28 against which a side of the substrate of the filter unit 12 rests.

The dimensions of the second frame-type cover 17 are selected in such a way that when the connector is assembled the lips 20 are enclosed by the second cover 17, thereby providing a good screening effect, and the filter unit 12 is clamped between the two stops 24, 28 and fixed thereto with a soldered joint 29. The connector constructed in this way is very resistant to shocks, impacts or vibrations. The connection ends 4 of the contact elements are connected to the respective electrode patches 14 of the filter unit 12 by means of soldered joints 30.

When the connector is fitted according to the preferred embodiment, the first 16 and the second 17 frame-type cover lie at either side against the raised edge 25 of the body 1, thereby giving a stable structure. Reinforcement ribs 31 are disposed at the side where the contact ends 3 extend inside the U-shaped cross section, in order to produce an effective support of the contact elements 2.

In order to prevent as far as possible the penetration of moisture from the frame opening 32 of the second cover 17 between the body 1 and the filter unit 12, the frame opening 32 is sealed according to the invention with a sealant, which effectively prevents the penetration of moisture and dirt into the connector, so that the anti-interference action of the filter unit is not thereby adversely affected. A silicone filler can be used as the sealant.

It will be clear that the connector according to the invention is not restricted to the embodiment shown, but that many modifications and additions are possible without going beyond the scope of the invention. There could be several contact elements for contacting, for example, 35 lines or, for example, three rows of contact elements for 55 or 88 lines, but there could also be a different shape of body 1 and the first cover 16 connecting thereto for contacting various types of connectors.

I claim:

1. A filter connector comprising an elongated body of electrically insulating material having, at each end thereof, fastening means, a plurality of electrical contact elements of electrically conducting material disposed in said elongated body, each contact element having a contact end and a connection end, a filter unit having a plurality of capacitor filter elements formed on a substrate of electrically insulating material, said substrate having passages formed therein for the contact elements to pass through, each filter element being associated with a corresponding passage and having a first electrode in electrical contact with a corresponding contact element passing through said corresponding passage, a screen formed of electrically conductive material enclosing the contact elements passing through said filter unit, said screen including a first frame cover comprising two halves which when assembled around said elongated body encloses the contact ends of said contact elements, each half of said first frame cover having lips which project toward the connection ends of said contact elements past the contact ends, said lips electrically contacting corresponding second electrodes of the filter elements of said filter unit, said screen further including a second frame cover enclosing the connection ends of the contact elements, said second frame cover also electrically contacting said second electrodes of the filter elements, said first and second frame covers engaging one another so that the filter unit is confined between them.

2. A filter connector according to claim 1 wherein the two halves of the first frame cover engage one another by means of a dovetail joint.

3. A filter connector according to claim 1 wherein the contact ends of the contact elements extend within the elongated body, said elongated body further including a raised edge along an external periphery thereof with slit-type passages for receiving the lips of the first frame cover.

4. A filter connector according to claim 3 wherein the lips of the first frame cover are bent over a distance at a free end and form a first stop situated in a frame opening and said second frame cover is provided with a second stop at one end in said frame opening, the lips of the first frame cover extending such a distance within the second frame cover that the filter unit is confined between said first and second stops.

5. A filter connector according to claim 4 wherein the first and second frame covers rest against the raised edge of the elongated body carrying the contact elements.

6. A filter connector according to claim 1 wherein the first and second frame covers are dimensioned so that the means for fastening the connector are accessible from the outside of the connector, said means having bar-shaped elements, each bar shaped element having a bore extending in a lengthwise direction of said element for fastening the connector with a screw connection, and with at least one projection, extending parallel to the contact ends and having a further bore in a lengthwise direction thereof for fastening the connector with a screw connection.

7. A filter connector according to claim 6 wherein the bar-shaped element disposed at one end of the elongated body is provided with one projection arranged in or near a center thereof, and the bar-shaped element disposed at the other end is provided with a projection at the periphery of the elongated body.

8. A filter connector according to claim 1 wherein respective electrodes of the filter elements are connected by means of soldering to the connection ends of the respective contact elements and the first and second frame covers.

9. A filter connector according to claim 1 wherein the second frame cover is sealed with a sealant to prevent moisture from penetrating into the connector at a side where the connection ends project outwards from the connector.

10. A filter connector according to claim 1 wherein the contact elements of the connector are contact pins with a rectangular cross-section.

* * * * *